US005330620A

United States Patent [19]

Berry et al.

[11] Patent Number: 5,330,620

[45] Date of Patent: Jul. 19, 1994

[54] BLEACHING PULP WITH CHLORIC ACID

[75] Inventors: Richard M. Berry, Ile Perrot; Michael Paleologou, Pierrefonds; Norman Liebergott, Laval, all of Canada

[73] Assignee: Pulp and Paper Research Institute of Canada, Pointe Claire, Canada

[21] Appl. No.: 841,101

[22] Filed: Feb. 25, 1992

[51] Int. Cl.[5] ..... D21C 9/12

[52] U.S. Cl. ..... 162/29; 162/87

[58] Field of Search ..... 162/66, 29, 67, 87, 162/88, 89, 76, 37, 40

[56] References Cited

U.S. PATENT DOCUMENTS

| | | | |
|---|---|---|---|
| 2,938,826 | 5/1960 | Marpillero et al. | 162/87 |
| 3,574,052 | 4/1971 | Westerlund et al. | 162/87 |
| 4,702,807 | 10/1987 | Bhattacharjee et al. | 162/87 |
| 4,915,927 | 4/1990 | Lipsztajn et al. | 423/472 |

FOREIGN PATENT DOCUMENTS 164634 9/1973 Czechoslovakia .

OTHER PUBLICATIONS

Heitman, TAPPI 39 (11) 754–757 (Nov. 1956).
Kachalov et al., A.B.I.P.C., vol. 31, No. 4, p. 510, #2404 (Dec. 1960).
Marpillero, A.B.I.P.C., vol. 31, No. 5, p. 630 #2919 (Jan. 1961).
Robert et al., "Celluloza Hirtie" 10 (7/8):265–7 (1961).
Abstract of French Patent 1,478,302 of Mar. 20, 1967.
Abstract of U.S. 3,770,646 to Partridge, issued Nov. 6, 1973.
Chemical Abstracts 86:141900f (1977).
Chemical Abstracts 86:141899n (1977).
Osipova et al., "Sb. Jr. VNII Tsellyul-Bumazh Prom." (58):25–38 (1971).
Osipova, "Sb. Jr. VNII Tsellyul-Bumazh Prom" (60):23–26 (1972).
Abstract of U.S.S.R. 368,365, published Jan. 26, 1973.
Osipova et al., "Sb. Jr. VNII Gidvoliza Rast. Matev." (24):109–118 (1974).
Janci et al., "Vyskum, Prace Odburu Papiera Celulozy" (20):V40–44 (1975).
Rapson et al., TAPPI 42(8) 642–649 (Aug. 1959).
Paleologou et al., Proceedings Pacific Paper Expo., Vancouver, B.C. Canada (Dec. 1990).
Hollingsworth, Proceedings TAPPI Pulping Conference 403–406 (1986).

*Primary Examiner*—Steve Alvo
*Attorney, Agent, or Firm*—Millen, White, Zelano & Branigan

[57] ABSTRACT

A process for bleaching pulp which employs chloric acid as the oxidizing agent, in the absence of a transition metal catalyst.

8 Claims, No Drawings

BLEACHING PULP WITH CHLORIC ACID

The present invention relates to a pulp bleaching process, more particularly to an improved method of bleaching pulp which employs chloric acid as the oxidizing agent.

BACKGROUND OF THE INVENTION

The use of chlorine dioxide produced by the reaction of sodium chlorate with a reducing agent in strong acid solutions to bleach pulp is an established technology with many variants. However, it has the drawback of requiring an external generating step which requires a costly generator. There has been considerable interest in the past in avoiding the generating step and obtaining the bleaching action of sodium chlorate by mixing the salt directly with the pulp slurry.

Addition of sodium chlorate in small amounts to chlorine water was suggested by Heirman, TAPPI 39 (11) 754–757 (November 1956), as a way of improving pulp strength and brightness. However, Marpillero, TAPPI 41 (5) 213A (1958), has stated that chlorate was quite ineffective when mixed with wood chips or a pulp, even at high concentrations. Conversely, several other investigators, viz., Kachalov etal., USSR Patent 112,344, published Jun. 25, 1958; Marpillero, TAPPI 41 (5), 213A (1958); Marpillero, "A.T I P. Bull ," (2):57–67 (1959); Robert et al , "Celluloza Hirtie," 10 (7/8):265–7 (1961) Societe Français du Xylon, French Patent 1,478,302, published Mar. 20, 1967; Partridge, Hooker Chem. Corp., U.S. Pat. No. 3,770,646, issued Nov. 6, 1973; Zakoschikob et al., "Sb Jr. Mosk Jekhnol. Int.," (28):165–70 (1976); Chugunkin et al , . . "Sb. Jr. Mosk. Jekhnol Int, " (28): 176–80 (1976); Osipova et al., "Sb Jr. VNII Tsellyul-Bumazh Prom., " (58):25–38 (1971); Osipova, . "Sb Jr. VNII Tsellyul-Bumazh Prom., " (60):23–26 (1972); Osipova et Patent 368,365, published January 26, 1973; Osipova et al., . "Sb. Jr. VNII Gidvoliza Matev." (24) :109–118 (1974 ); and Janci et al , "Vyskum Prace Odburu Papiera, Celulozy," (20):V40–44 (1975), have claimed that the use of chlorate for pulping wood chips and bleaching pulp was possible by employing (1) an acid medium, or (2) a reducing agent ( i. e., tartaric acid, citric acid, or formaldehyde) plus a catalytic salt containing vanadium, titanium, molybdenum, arsenic, silver, manganese or chromium.

Marpillero, supra, also used mixtures of sodium chlorate, hydrochloric acid and vanadium to bleach pulps. Rapson et al., TAPPI 42(8) (1959) compared the use of this mixture of chemicals with the direct use of chlorine dioxide to bleach pulp and determined that it was more economical and less damaging to the pulp to first produce chlorine dioxide in a generator and then add it to the pulp.

A summary of the conditions for, and the results of, bleaching with "activated" chlorate (sodium chlorate containing one of the salts of the transition metals described above) is shown in Table I, below. Robert et al., supra, has observed that kraft pulp suffered serious degradation by bleaching with activated chlorate.

Chloric acid has been used directly for bleaching by Polcin et al., Czechoslavakian Patent 164634, published September 1976. They showed that, with vanadium as a catalyst and the addition of a mild reducing agent, chloric acid could bleach pulp, probably through the formation of chlorine dioxide. Indeed, when used in extreme concentrations at 90° C for 6 hours, chloric acid was found to bring thin sprucewood chips to 87% brightness in 51% yield. However, there is little information in this publication on the effect of chloric acid on the carbohydrates in the pulp and the scope of the reaction.

Chloric acid is both a strong acid and a powerful oxidant. It is also an intermediate in the production of chlorine dioxide which, in turn, is used as a bleaching agent in the pulp and paper industry. Chloric acid is formed by acidifying a sodium chlorate solution with strong acid, e.g., sulfuric acid. The process generates sodium sulfate as a by-product, which may or may not be useable in other parts of the pulp and paper process.

Another method of generating chloric acid is by the action of a suitable acid, e.g., sulfuric acid, on a soluble chloric acid salt, e.g., barium chlorate, which forms a precipitable salt (barium sulfate) therewith. This method is of laboratory interest only.

There is considerable literature describing the preparation of chlorine dioxide from sodium chlorate. All this literature, however, describes the same initial step wherein sodium chlorate is treated with a strong acid before various reducing agents are applied to the resulting solution.

It is now possible to generate chloric acid using an electrolytic system (Lipsztajn et al., U.S. Pat. No. 4,915,927, issued Apr. 10, 1990), or using a membrane system involving stacked pairs of membranes by electro-dialytic ion separation of sodium chlorate (Paleologou et al., Proceedings Pacific Paper Expo., Vancouver, B.C., Canada (December 1990). With these new technologies, it is technologically feasible to use externally-generated chloric acid in accordance with this invention.

OBJECTS OF THE INVENTION

It is an object of the invention to provide an improved process for bleaching pulp with chloric acid.

Another object of the invention is to provide an improved process for bleaching pulp which does not require a catalyst or high concentrations of acid which damage the pulp.

Another object of the invention is to provide an improved process for bleaching pulp which avoids the toxic effluent produced by heavy metals.

Another object of the invention is to provide an improved process of bleaching of pulp economically, using a chlorate salt without generating chlorine dioxide and without the use of toxic heavy metal catalysts, thereby eliminating the generating equipment required for generating chlorine dioxide, as well as facilitating safety and handling.

A further object of the invention is to provide an improved pulp bleaching process whereby improved pulp brightness and resistance to loss of brightness on aging are obtained.

Upon further study of the specification and appended claims, further objects and advantages of this invention will become apparent to those skilled in the art.

SUMMARY OF THE INVENTION

The above objectives are achieved by the present invention, which is an improved method for preparing bleached pulp, comprising oxidizing the pulp with chloric acid as the oxidizing agent, in the absence of a transition metal catalyst.

Thus, in a process aspect, the present invention relates to a process for bleaching pulp with an oxidizing agent which comprises oxidizing the pulp employing chloric acid as the oxidizing agent, in the absence of a transition metal catalyst.

DETAILED DESCRIPTION OF THE INVENTION

According to the present invention, pulp is bleached employing, as the oxidizing agent, chloric acid without a transition metal catalyst and supplemental acidity, to delignify pulp fibers directly without using any of the commonly used alternative oxidants, such as chlorine and chlorine dioxide.

The chloric acid is produced by the action of a strong acid on a chlorate salt, e.g., sodium chlorate, in situ in the pulp slurry or externally generated and thereafter added to the pulp. Examples of suitable strong acids are the mineral acids, e.g., hydrochloric acid, sulfuric acid and nitric acid. The amount of acid employed is from about 2.5% to about 100%, preferably about 5% to 15% It is added to the pulp at a charge concentration of about 10% to about 40%, preferably below 25%, calculated on the oven dry (o.d.) pulp.

The pulp is sequentially oxidized a number of times with chloric acid in the absence of a transition metal catalyst and optionally in the presence of a promoting agent, followed by extraction with an extractant, e.g., NaOH, in a conventional manner. The conventional sequence for a number of years has been CEDED (chlorine-sodium hydroxide-chlorine dioxide-sodium hydroxide-chlorine dioxide) or a variant of it. In the present invention, chloric acid could be used in a number of present stages of bleaching which use an oxidant. Chloric acid could replace both chlorine and chlorine dioxide in such a sequence.

In a preferred embodiment, the oxidizing solution is recycled and reused a plurality of times, because all of the oxidant is not consumed, particularly at high oxidant charge concentrations and the unconsumed portion can provide a portion of the oxidant for the next batch of pulp. This can be repeated a plurality of times without interfering with the oxidation, e.g., by recycling the separated effluent from the oxidation stage as a portion of the slurry water for unoxidized chips or pulp.

Examples of transition metal catalysts which are conventionally used are catalytic compounds of silver, manganese, pentavalent vanadium and hexavalent chromium, inorganic salts, such as nitrate, chloride, sulfate, chlorate, as well as organic salts, such as formate, oxalate, acetate, acetyl acetonate and the like. Specific examples are sodium dichromate and vanadium pentoxide.

A characterizing aspect of the invention is that chloric acid alone, when used at high concentration, e.g., at least about 0.5 M in the reaction solution, preferably about 0.9 M to 1.3 M on an o.d. pulp weight basis, delignifies the pulp. Unexpectedly, it has been found that using chloric acid directly to delignify pulps does not require the addition of a transition metal catalyst or the presence of a high concentration of an acid, as required to form chlorine dioxide therefrom. Such a process allows the direct use of chloric acid for bleaching pulps, which enables capital and operation cost reductions by eliminating the use of chlorine dioxide and removing the need for the production equipment associated with the generation of chlorine dioxide. This new process also facilitates handling and safety.

A conventional oxidizing agent, e.g., chlorine dioxide or chlorine, is usually required for bleaching pulp. The present invention employs chloric acid to delignify the pulp without the requirement of a transition metal catalyst or the presence of a high concentration of a supplemental acid to convert the sodium chlorate to chloric acid.

By "high concentrations of acids or supplemental acidity" is meant the acidity used conventionally in chlorine dioxide generators. A chlorine dioxide generator operates with a concentration of 9 to 10 N sulfuric acid and 1.1 to 1.3 M sodium chlorate in an R8 generator (Hollingsworth, G.A., Proceedings TAPPI Pulping Conference 403 (1986)). These concentrations of acid represent about 450% chemical equivalents of the chloric acid salt employed.

The process can be conducted in the presence of sodium chloride, sulfur dioxide and/or methanol, e.g., at a weight charge, based on o.d. pulp, of about 0.05% to 5%.

The present process is applicable to any cellulosic material in general. It is herein specifically described in relation to bleaching of wood pulp, such as that obtained from hemlock, Douglas fir, balsam, cedar, black spruce, birch, aspen, maple and the like. The wood pulp is generally first prepared for bleaching by delignifying by any known process, such as kraft or sulfite processes wherein wood is pulped with partial removal of lignin. Such processes also more completely expose the fibers, thereby providing more complete contact between the bleaching reagents and the fibers.

The pulp suspension is preferably bleached with sodium chlorate, usually at a charge amount of up to about 150% based on o.d. pulp, preferably about 75% to 105% based on o.d. pulp, acidified in situ with hydrochloric acid to form chloric acid, usually at charges of up to about 30% based on o.d. pulp, preferably about 15% to 20% based on pulp, or from chloric acid (externally generated)alone, at charges on pulp amounts of up to about 100% based on o.d. pulp, preferably about 70% to 100% based on o.d. pulp.

Acidified sodium chlorate or chloric acid is used instead of the oxidizing agents conventionally used in at least one of the oxidizing stages of a bleaching sequence. The operating conditions of the bleaching stage can be left unchanged, but best results are obtained with chloric acid (or acidified chlorate) when retention times of at least about 1 hour, at a temperature above 50° C., preferably about 60° C. to 70° C., and pulp consistencies of about 10% or more, preferably about 8% to 12% are employed.

Following the completion of the oxidizing stage, the oxidized pulp, after separation (and preferably recycling) of the effluent, is subjected to alkaline extraction in a conventional manner, e.g., with about 1% to 3% sodium hydroxide.

Because high charges of chloric acid are used in order to obtain a bleaching action at a significant rate, the unconsumed chemical ordinarily is recovered and recycled for efficient chemical usage.

As will be apparent, when the invention is conducted with a sodium chlorate charge of less than 45% on o.d. pulp, a transition metal catalyst (or a longer reaction time) is required.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever. In the foregoing and in the following examples, all temperatures are set forth uncorrected in degrees Celsius and unless otherwise indicated, all parts and percentages are by weight. The entire disclosure of all applications, patents and publications, cited above and below, are hereby incorporated by reference.

EXAMPLES

General Experimental

EXAMPLE 1

The action of acidified sodium chlorate as a delignification agent is described in this example, with and without the use of a catalyst to activate the chlorate.

A softwood kraft pulp (unbleached kappa number, 28.5; 0.5% Cuene viscosity, 32 mPa.s) was treated under constant conditions (Table II) with 6 levels of chlorate charge on pulp. The pulp was mixed with the prescribed charge of sodium chlorate and then 1 molar hydrochloric acid was added until the charge of HCl on o.d. pulp was 20%. The pulp consistency was adjusted with water and the reaction allowed to continue for 1 hour at 54° C.

As shown in Table II, pH, kappa number, 0.5% CED viscosity and the brightness after a standard caustic extraction were determined by conventional methods such as CPPA Standard Procedures Manual, Brightness Test El. A kappa number after extraction of less than 6.1 was obtained only at a sodium chlorate charge of higher than 45% on weight of o.d. pulp. Higher initial concentrations further delignified the pulp and with a charge of about 150% on o.d. pulp, the CE kappa number was 2.5. Lower charges (15 and 30%) gave lesser delignification and higher CE kappa numbers of 14.2 and 9.5, respectively.

Sodium chlorate analysis (Table II) indicates that, regardless of the chlorate charge, only 10–20% of sodium chlorate on pulp was consumed. Thus, to make efficient use of the oxidant, the bleaching effluent should therefore be recirculated for further use. Viscosity was only reduced markedly when the sodium chlorate charge was greater than 100% on pulp. The results show that a strong bleached pulp can be obtained by this process.

The results of adding a $V_2O_5$ catalyst to activate the chlorate are compared with those obtained with the unactivated process of the invention in Table III. At charges of 15% and 30% $NaClO_3$ on o.d. pulp, $V_2O_5$ accelerates the delignification reaction, but with a sodium chlorate charge of 45% on o.d. pulp or more, the delignification is accelerated but the benefit of the catalyst addition is no longer observed. Without the catalyst, the resulting effluents are less hazardous and acceptable.

EXAMPLE 2

The action of chloric acid on pulp without the addition of a transition metal catalyst is described in this example (Table IV).

A black spruce kraft pulp of kappa number 29.2 was bleached with a 46.2% charge on o.d. pulp of chloric acid (equivalent to a 58.3% charge on o.d. pulp of sodium·chlorate), in the same manner as Example 1. Table IV shows that the bleaching action is dependent on temperature with a very low post E(extraction)-stage, kappa number of 1.1 being possible at 90° C. The ISO Brightness of this pulp was 69.2%, measured by conventional methods. The consumption of chemicals is lower when chloric acid rather than acidified sodium chlorate is used, i.e., only 4.9% chloric acid on o.d. pulp was consumed in giving a CE kappa number of 1.1, whereas 13% of acidified sodium chlorate was consumed in giving a CE kappa number of 6.1.

EXAMPLE 3

The action of chloric acid on pulp without the addition of a transition metal catalyst but with the addition of sodium chloride is described in this example (Table V).

A black spruce kraft pulp of kappa number 29.2 was bleached with a 46.2% charge on o.d. pulp of chloric acid (equivalent to a 58.3% charge on o.d. pulp of sodium chlorate), in the same manner as Example 1. In this example, however, different amounts of sodium chloride were also added to the pulp and chloric acid mixture. Table V shows that the bleaching action is increased by the addition of sodium chloride. The addition of 4.3% sodium chloride on o.d. pulp decreases the kappa number measured after the chloric acid treatment from 22.4 when no sodium chloride is used to 19.8.

TABLE 1

Summary of Conditions and Results of Activated Chlorate* Bleaching

| Type of Pulp | Chlorate Charge, % on Pulp | Catalyst | Conditions: Consistency (%) | Time (H) | Temperature (°C.) | pH | Brightness (%) | Remarks | Author | Ref. No. |
|---|---|---|---|---|---|---|---|---|---|---|
| Sulfite | 40 | vanadium | 5 | 3 | 50+ | 2 | 72 | marked pulp degradation | A. Robert and A. Viallet | 5 |
| Sulfite | 40 | vanadium | 5 | 1 | 50+ | 2 | 67 | little loss of pulp quality | A. Robert and A. Viallet | 5 |
| Birchwood chips | 100 | vanadium | 20 | 12 | 50+ | 1.35 (in.) | 76 | pulping | A. Robert and A. Viallet | 5 |
| Sulfate | 4 | vanadium | 15–20 | 4–8 | 50–60 | 2.4 | 80 | two stages | A. Kachalov and I. Bykova | 2 |
| | 3 & 0.4 | | 15–20 | 4–8 | 50–60 | 2.4 | 84 | three stages | | |
| Bisulfite | 5 | vanadium | 15–20 | 4–8 | 50–60 | 2.4 | 85.0 | two stages | P. Marpillero | 4 |
| | 4.5 & 0.5 | | 15–20 | 4–8 | 50–60 | 2.4 | 87.0 | three stages | | |
| kraft Sulphite, Soda straw | 0.5–2.0 | amm. molybdate and amm. metavanadate | 7 | 7 | 70–85 | 7 | 70–92 | bleaching liquor contains $ClO_3^-$, catalyst and one or more chlorates, peroxides or persulfates | Société Francais du Xylon | 6 |

*Sodium chlorate with the addition of a transition metal catalyst.

TABLE II

Acid Chlorate Treatment Without the Use of a Catalyst Followed by Caustic Extraction of an Unbleached Softwood Kraft Pulp (Kappa No. 28.5, 0.5% CED Viscosity, 32.0 mPa · s)

| Run No. | Chemicals Added on Pulp (% on O.D. Pulp) $NaClO_3$ Added | $NaClO_3$ Consumed | HCl (%) | pH Initial | pH Final | Kappa No. | 0.5% CED Viscosity (mPa · s) | Brightness (%) |
|---|---|---|---|---|---|---|---|---|
| 11 | 15 | 10 | 20 | 1.5 | 1.2 | 14.2 | 29.7 | 33.2 |
| 12 | 30 | 11 | 20 | 1.3 | 1.2 | 9.5 | 28.0 | 37.2 |
| 7 | 45 | 13 | 20 | 1.2 | 1.0 | 6.1 | 28.5 | 40.7 |
| 6 | 75 | 15 | 20 | 1.2 | 0.5 | 4.1 | 26.0 | 47.2 |
| 8 | 105 | 16 | 20 | 0.9 | 0.8 | 3.0 | 23.6 | 52.5 |
| 12 | 150 | 20 | 20 | 1.3 | 1.2 | 2.5 | 17.0 | 56.7 |

| Acid Chlorate Conditions | | Extraction Conditions | |
|---|---|---|---|
| Pulp Consistency | 10% | Pulp Consistency | 10% |
| Temperature | 54° C. | Temperature | 60° C. |
| Time | 1 h | Time | 1 h |
| | | Charge NaOH | 3% |
| | | Exit pH | 10.9–11.2 |

*Analysis of $ClO_3^-$ and hence determination of $NaClO_3$ according to procedure recommended by H. W. Rapson (PPRIC 67 (1) T-54-55, 1966), no $ClO_3^-$ was detected in the analysis.

TABLE III

Comparison of Chlorate Delignification with and without $V_2O_5$ Unbleached Kraft Pulp (Kappa No. 28.5, Viscosity 32.0 mPa · s)

| Run No. | Chemical Added on Pulp (% on O.D. Pulp) $NaClO_3$ | HCl | $V_2O_5$ | Properties After Extraction 0.5% CED Kappa No. | Viscosity (mPa · s) | Brightness (%) |
|---|---|---|---|---|---|---|
| 11 | 15 | 20 | 0 | 14.2 | 29.7 | 33.2 |
| 12 | 30 | 20 | 0 | 9.5 | 28.0 | 37.2 |
| 13 | 45 | 20 | 0 | 6.1 | 28.5 | 40.8 |
| 14 | 15 | 20 | 0.14 | 7.4 | 29.8 | 40.2 |
| 15 | 30 | 20 | 0.14 | 6.8 | 29.3 | 41.7 |
| 16 | 40 | 20 | 0.14 | 6.0 | 28.6 | 42.5 |

| Chlorate Treatment | | Caustic Extraction | |
|---|---|---|---|
| Consistency | 10% | Consistency | 10% |
| Temperature | 54° C. | Temperature | 60° C. |
| Time | 1 h | Time | 1 h |
| pH | 1.5–1.0 | pH | 10.9–11.2 |
| | | Charge NaOH | 3% on pulp |

TABLE IV

The Bleaching Action of Chloric Acid When Applied as a 46.2% Charge

| $HClO_3$ Charge (%) on O.D. Pulp | Temperature (°C.) | $HClO_3$ Consumed (%) on O.D. Pulp | Kappa Number Before Extraction | Kappa Number After Extraction |
|---|---|---|---|---|
| 46.2 | 70 | 0.5 | 22.5 | 14.5 |
| 46.2 | 90 | 4.9 | 7.2 | 1.1 |

Conditions:

| | |
|---|---|
| Unbleached pulp | black spruce; kappa number, 29.2 |
| Chlorate treatment | 3 h; 10% consistency |
| Extraction stage | 3% NaOH on o.d. pulp; 1.5 h at 70° C.; 10% consistency |

TABLE V

The Bleaching Action of Chloric Acid When Applied as a 46.2% Charge

| $HClO_3$ Charge (%) on O.D. Pulp | NaCl Charge (%) on O.D. Pulp | $HClO_3$ Consumed (%) on O.D. Pulp | Kappa Number Before Extraction | Kappa Number After Extracton |
|---|---|---|---|---|
| 46.2 | 0 | 0.5 | 22.5 | 13.3 |
| 46.2 | 0.04 | 2.6 | 21.7 | 13.3 |

TABLE V-continued

The Bleaching Action of Chloric Acid When Applied as a 46.2% Charge

| | | | | |
|---|---|---|---|---|
| 46.2 | 0.43 | 5.7 | 21.4 | 12.6 |
| 46.2 | 4.29 | 2.7 | 19.8 | 10.2 |

Conditions:

| | |
|---|---|
| Unbleached pulp | black spruce; kappa number 29.2 |
| Chlorate treatment | 3 h at 70° C.; 10% consistency |
| Extraction stage | 3% NaOH on o.d. pulp; 1.5 h at 70° C.; 10% consistency |

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for bleaching pulp which comprises employing as the sole oxidizing agent chloric acid generated separately from the pulp slurry and thereafter added thereto, at a charge concentration on pulp amount of about 70% to 100% based on o.d. pulp, and wherein the chloric acid is produced at a charge concentration of about 10% to about 40% generated by reaction of a metal chlorate salt with from about 5% to about 15% chemical equivalent of a strong mineral acid, in the absence of a transition metal or heavy metal catalyst, and recovering and recycling residual unreacted chloric acid.

2. A process according to claim 1, wherein the oxidation is conducted at more than about 50° c. with a retention time of at least about an hour.

3. A process according to claim 1, wherein the o.d. pulp concentration is above about 10%.

4. A process according to claim 1, wherein the amount of strong mineral acid employed is below 25% based on o.d. pulp weight.

5. A process according to claim 1 wherein the pulp consistency is more than about 10%, and the process is conducted at more than 50° C. with a retention time of at least an hour.

6. A process according to claim 5, wherein the chloric acid is produced in situ in the pulp slurry by acidfying sodium chlorate with acid.

7. The process of claim 1, wherein the pulp is kraft pulp.

8. The process of claim 1, wherein the pulp is kraft pulp which is bleached at a pulp consistency of more than about 10%, the mineral acid is hydrochloric acid and the process is conducted at more than 50° C. with a retention time of at least an hour.

* * * * *